United States Patent [19]

Ato

[11] 4,360,190

[45] Nov. 23, 1982

[54] POROUS NOZZLE FOR MOLTEN METAL VESSEL

[76] Inventor: Junichi Ato, 21, Maborikaigan, 2-chome, Yokosuka-shi, Kanagawa-ken, Japan

[21] Appl. No.: 243,898

[22] Filed: Mar. 16, 1981

[51] Int. Cl.[3] ..... C21C 5/48

[52] U.S. Cl. ..... 266/220; 266/236; 266/265

[58] Field of Search ..... 266/220, 236, 265; 75/60

[56] References Cited

U.S. PATENT DOCUMENTS 3,330,645 7/1967 De Moustier ..... 75/60
3,891,429 6/1975 Cox ..... 75/60
3,918,613 11/1975 Shapland ..... 266/220
3,971,548 7/1976 Folgero ..... 266/265

*Primary Examiner*—P. D. Rosenberg
*Attorney, Agent, or Firm*—Fay & Sharpe

[57] ABSTRACT

A refractory porous nozzle which is arranged at the bottom of a molten metal vessel, characterized in that said porous nozzle is made in one body having a flange portion at its upper portion and a cylindrical portion at its lower portion, the outer peripheral surface of the main body of said porous nozzle is gas-tightly enclosed with a steel shell, a gas pool is provided between the bottom surface of said flange portion and the outer peripheral surface of said cylindrical portion, and the inner peripheral surface of said steel shell, and the gas pool is communicated with an inert gas feeding pipe.

3 Claims, 4 Drawing Figures

POROUS NOZZLE FOR MOLTEN METAL VESSEL

This invention relates to an improvement in a porous nozzle which is arranged at the bottom of a molten metal vessel, and the objects of which are to float up and separate the non-metallic inclusions in molten metal in said vessel and to prevent a slag involvement and a nozzle opening closure. More particularly it relates to an improvement of a porous nozzle mounted at the bottom of a ladle or tundish container of the molten metal vessel.

Generally the nozzle of a ladle or tundish container is constructed with a dense refractory. However, non-metallic inclusions in the molten steel often adhere in the nozzle opening during the flowing-down of the melt to cause a contraction and a closure thereby often bring about troubles in the pouring operation of the melt. To prevent these disadvantageous phenomena, therefore, it is generally carried out to employ a refractory porous nozzle in which inert gases are jetted into the inner peripheral surface of the nozzle through the pores thereby to form a gas film and remove the things adhered to the nozzle opening. Further, for another purpose, in order that the non-metallic inclusions in the molten steel within the vessel are removed to make a purified and good quality molten steel there is also carried out a method in which separately from a porous nozzle, a refractory porous plug is arranged at the bottom of a container such as ladle or tundish, and inert gases are jetted into the molten steel through the pores of the porous plug when the non-metallic inclusions are floated up and separated and the purity of said molten steel is improved. There is another method which does not use a porous plug. To take a tundish for example, a refractory weir is provided within said vessel to change the flow of the molten steel, and the non-metallic inclusions in the molten steel are floated up and separated. According to the method in which a weir is provided in a tundish container, it exhibits effects in its own way for floating up and separating the non-metallic inclusions. In view that the dimension of tundish is limited because of structure and design of a continuous casting equipment, however, it is difficult to make an effective weir shape or arrange an effective weir within a comparatively narrow tundish, and it is known that not only the tundish design becomes complicate but also it is difficult to fix a weir within the tundish.

Further, the porous nozzle arranged in conventional tundishes has effects for preventing contraction and closure of nozzle, but generally in a continuous casting working said nozzle may involve the non-metallic inclusions, slag, etc. which float up by a turbulence generated at the upper portion of the nozzle opening when the ladle is replaced, thereby causing a lowered quality of steel. Furthermore, according to the method in which a porous plug is provided at the bottom of a tundish container and inert gases are jetted into the molten steel, it is effective for floating up and separating the inclusions, but the plug must be arranged at a position different from that of the nozzle so that a complete effect cannot be exhibited for preventing the slag involvement, due to the tubulence generated at the upper portion of the nozzle opening when replacing the ladle as referred to above.

In view of said various demerits of conventional methods, the present invention provides an integral, flange-shaped, porous nozzle which has in combination a function of jetting inert gases upwardly into the molten steel by a porous plug and a function of jetting the inert gases from the inner peripheral surface of a porous nozzle to prevent the nozzle from closing, and in which the inclusions in the molten steel are floated up and separated whereby the nozzle is prevented from closure, and it can avoid a slag involvement caused by the turbulence generated at the upper portion of the nozzle opening when the ladle is replaced, while allowing a continuous casting of a molten steel of high quality. That is, it is the characteristic feature of the invention that the porous nozzle of the invention has in combination both the functions of jetting inert gases from the porous refractory layer of the flange portion into the upper portion in the molten steel, and of jetting the inert gases into the nozzle opening.

The invention will now be described more in detail with reference to the accompanying drawings which show some embodiments of the invention, in which FIG. 1 shows an embodiment of a porous nozzle of the invention and a vertical section of a porous nozzle in one body in which the bottom of the flange portion is communicated with a gas pool of the cylindrical outer circumference;

Figure 1:
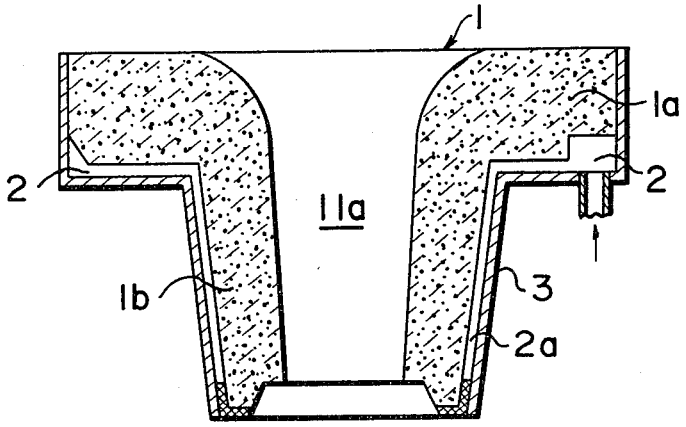

In FIG. 1 the porous nozzle arranged at the pouring-out portion at the bottom of a molten steel vessel is mounted in the nozzle socket at the central portion of a nozzle-receiving brick, the outer peripheral surface of which brick being in contact with the lining refractory brick of said vessel bottom. The object of the invention is to provide an excellent porous nozzle in which the vessel is surrounded with an iron shell (3) in such a manner that a circular gas pool (2) is provided at least at a part or the whole of the outer peripheral surface of a porous refractory layer constituting the main body of a porous nozzle (1) and at least at a part or the whole of the flange portion at the lower end of a flange porous layer (1*a*), the gas pool (2) is communicated with a vent clearance (2*a*) in the outer peripheral surface of the nozzle cylindrical portion, inert gases are jetted through a piping from the outside into a nozzle opening (11*a*) from the upper surface of said porous refractory layer (1*a*) constituting the flange portion of the porous nozzle and from the inner periphery surface of a porous refractory layer (1*b*) constituting the nozzle cylindrical portion, and by doing so it is possible easily to float up and separate the non-metallic inclusions in the molten steel while preventing the nozzle opening from closure and slag involvement.

Figure 2:
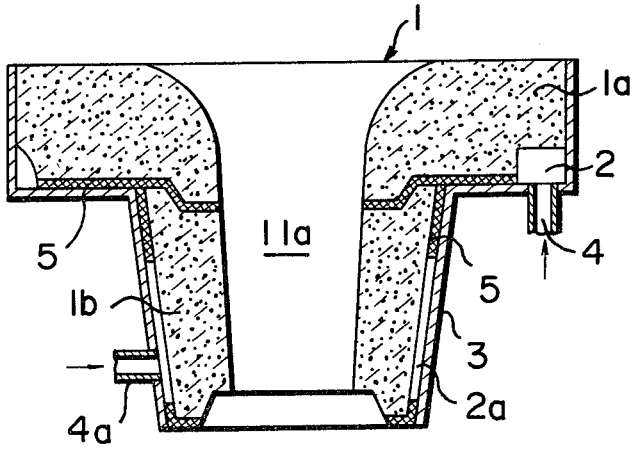
FIG. 2 shows another embodiment of the invention and a vertical section of a porous nozzle in which the flange portion and the cylindrical portion are made in one body through a sealing member.

FIG. 2 shows an embodiment of a porous nozzle where the porous refractory layer of FIG. 1 is made double. That is, this porous nozzle is the one in which the porous refractory layer (1*a*) is isolated by a sealing member (5) from the porous refractory layer (1*b*) constituting the cylindrical portion whereby the function of jetting the inert gases upwardly in the molten steel is separated from the function of jetting them into an nozzle opening (11*a*). The present porous nozzle has in one unit a mechanism of jetting gases to the upper surface of the flange, permeating the pores of the flange porous refractory layer through a gas blowing opening (4) mounted at the end of a gas pool (2) provided in the circumference at the lower end of the flange of said porous nozzle, and a mechanism of jetting the gases into the nozzle opening (11*a*), permeating the pores of the porous refractory layer (1*b*) of the nozzle cylindrical portion through a gas pool (2*a*) surrounded by an iron shell (3). A sealing member (5) of separating said two mechanism may be made of silica, alumina or any other optional sintered refractory to prevent gas leakage completely, and the important thing is that a gas leakage to the outside is prevented and that a gas permeation is prevented between the refractory porous layer of the flange portion and the porous refractory layer of the nozzle cylindrical portion through said sealing member (5).

The reason of separating the gas ejection mechanism in the flange upper surface from that in the nozzle opening (11*a*) is that specifically in a porous nozzle for tundish container, owing to the physical pressure difference between the molten steel static pressure within the tundish, which is received by the upper surface of the flange, and the molten steel kinetic pressure (pressure is reduced based on the Bernoulli's theorem) which is received by the inner peripheral surface of the nozzle during the time when the molten steel flows down within said nozzle opening, it is necessary to separately adjust the gas blowing pressure in the flange portion and that into the nozzle opening (11*a*). Concerning the pressure of the gas blown into the nozzle opening (11*a*), it is possible to prevent the nozzle from contraction and closure by forming a gas curtain in the inner peripheral surface of the nozzle opening, and with a gas pressure unnecessarily raised the inert gases are involved into the molten steel when the melt flows down into the nozzle opening, and therefore there is an unfavorable possibility that pin holes occur in the solidifying process of the molten steel. Further, the present invention has a great number of merits in such that in the case of a closing mechanism of a sliding nozzle (lower nozzle) constituting the lower portion of said porous nozzle, it will suffice only to eject gas from the upper surface of the flange thanks to a plurality of blow openings as arranged, and if necessary it is capable of adjusting the gas ejection and gas pressure freely so as to save the use amount of inert gases.

Figure 3:
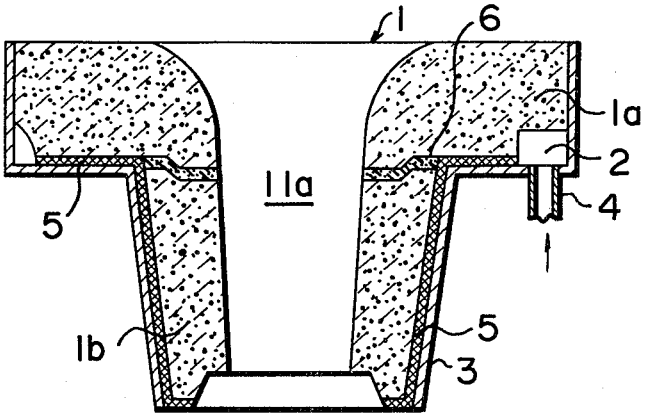
FIG. 3 shows still another embodiment of the invention and a vertical section of a porous nozzle in which the flange portion and the cylindrical portion are made in one body through a fine porous refractory layer.

According to the porous nozzle of FIG. 3, the porous refractory layer of the main body of said porous nozzle is constructed in such a way that between the porous refractory layer of the flange portion and that of the cylindrical portion there is formed a fine porous refractory layer (6) which is fine porosity and has a great gas resistancy compared with the porous refractory layer of the main porous body, inert gases are guided from the gas blow opening (4) and the gases are jetted, through the gas pool (2), from the upper surface of the flange, permeating the pores of the porous refractory layer (1*a*) of the flange portion, while a part of the inert gases permeates through the porous refractory layer (1*b*) of the vertical side through the fine porous refractory layer (6) thereby to be jetted into the nozzle opening. When a part of the inert gases permeates through said fine porous refractory layer (6) the gas pressure is considerably reduced so that the amount of the gas entering into the nozzle opening (11*a*) is decreased and therefore, the molten steel will never be involved with inert gas.

In the drawings the fine porous refractory layer is not flat in its sectional configuration but it may be of optional shape, and naturally the thickness of said layer is optionally selected and said layer is formed in shape and thickness answering the conditions, considering the permeation and resistance of the gas.

Figure 4:
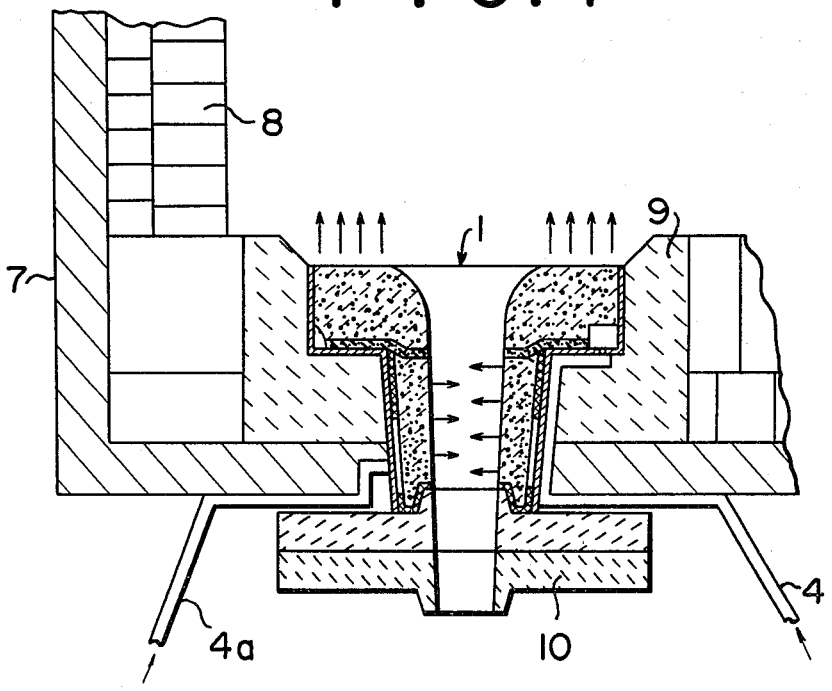
FIG. 4 is a vertical sectional view showing a state in which the porous nozzle of FIG. 2 is set at the bottom of a molten metal vessel.

FIG. 4 is a schematical sectional view of the porous nozzle of FIG. 2, in which the porous nozzle wherein the ejection mechanism from the flange surface is separated from that into the nozzle opening, is arranged at the bottom of a molten metal vessel. Further, FIG. 4 is also a sectional view of the porous nozzle (1) as arranged, in which a through hole is provided at the bottom of a vessel where a iron casing (7) is lined with refractory bricks (8), said porous nozzle being mounted in the central zone of the inner peripheral surface of a nozzle-receiving brick (9) fixed in said through hole. FIG. 4 is examplified with a porous nozzle being connected at its lower end to a sliding nozzle (10), but said nozzle can naturally be applicable to melt discharging nozzles which adopt a stopper system as a nozzle opening and closing mechanism.

The invention will now be described by way of example.

By mounting the porous nozzle (shown in FIG. 2) of the invention to a tundish container there was carried out a 4-continuous casting operation for steel plates for motorcars, but as expected initially there was neither contraction nor closure of the nozzle at all, and not observed any slag involvement when the ladle was replaced. Moreover, even the index of the non-metallic inclusions could be reduced by 30–40% compared with conventional porous nozzles to obtain a very satisfactory result. The conditions of carrying out the operation are as follows:

| | | |
|---|---|---|
| Kind of steel: | | Steel plate for motorcar |
| Capacity of tundish: | | 45 t |
| Number of continuous castings: | | 4-continuous casting (cc) |
| Capacity of ladle: | | 280 t |
| Casting tonnage: | | 280 × 4 = 1,120 t |
| Blow amount of inert gas (Ar): | | |
| (A) | Gas pool blow opening (4) of the flange portion | |
| | Gas pressure: | 0.9 kg/cm$^2$ |
| | Gas flow: | 8 Nl/min |
| (B) | Blow opening (4a) of the cylindrical portion | |
| | Gas pressure: | 0.7 kg/cm$^2$ |
| | Gas flow: | 6 Nl/min |

The more the porous nozzle of the invention widens its width in an operable range in the length in the width direction of the flange, the more it produces its effect. However, putting the shape and capacity of the melt vessel and the problems of said vessel when operating into consideration the optimum width and thickness of the flange should be selected. In the drawings the upper surface of the flange is shown in a flat configuration, but the shape is not limited to said configuration and there is no trouble in use even if the surface is curved or uneven a little. The important thing is that the porous nozzle has a function for ejecting an inert gas toward the upper portion of the molten metal. The porous nozzle of the invention has been described in detail particularly with respect to a tundish nozzle for molten steel, but the present invention is very useful industrially in that it is applicable to vessels for other molten metals such as copper.

What is claimed is:

1. A refractory porous nozzle assembly which is adapted to be positioned at the bottom of a vessel for containing molten metal, comprising a porous refractory nozzle body including a generally cylindrical flanged portion having an upper surface and a lower surface, and a lower tapered cylindrical portion having an outer peripheral surface; a hollow metallic outer shell enclosing said porous refractory nozzle body; a first gas conduit between the lower surface of said flange portion and the inner peripheral surface of said metallic shell; a second gas conduit between the outer peripheral surface of said lowered tapered cylindrical portion and the inner surface of said metallic shell; and at least one gas feed line in communication with at least one of said first and second conduits.

2. The refractory porous nozzle assembly as described in claim 1 wherein the upper flange portion and lower tapered cylindrical portion are separated from each other by means of a sealing member, and each gas conduit communicates with different inert gas feed line.

3. The refractory porous nozzle assembly as described in claim 1 wherein the upper flange portion and the lower tapered cylindrical portion are separated from each other by a porous refractory layer more resistant to the flow of gas than the nozzle body; and only a gas first conduit is provided.

* * * * *